US008807918B2

(12) United States Patent
Hagshenas

(10) Patent No.: US 8,807,918 B2
(45) Date of Patent: Aug. 19, 2014

(54) ROTATING CATCHER FOR IMPELLER CONTAINMENT

(75) Inventor: Behzad Hagshenas, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1097 days.

(21) Appl. No.: 12/818,409

(22) Filed: Jun. 18, 2010

(65) Prior Publication Data

US 2011/0308229 A1 Dec. 22, 2011

(51) Int. Cl.
*F01B 25/16* (2006.01)

(52) U.S. Cl.
USPC ..... 415/9; 416/182

(58) Field of Classification Search
USPC ..... 415/9; 416/180, 181, 182, 231 B, 235, 416/236 R
See application file for complete search history.

(56) References Cited

U.S. PATENT DOCUMENTS

| | | | | | |
|---|---|---|---|---|---|
| 3,652,176 | A * | 3/1972 | Walsh | 415/9 |
| 4,472,160 | A | 9/1984 | Wright | |
| 4,521,160 | A * | 6/1985 | Bouiller et al. | 416/218 |
| 4,708,591 | A | 11/1987 | Roman | |
| 4,797,064 | A | 1/1989 | Ferris et al. | |
| 4,915,589 | A * | 4/1990 | Gessler et al. | 416/241 B |
| 4,930,983 | A | 6/1990 | Byrnes et al. | |
| 4,986,736 | A * | 1/1991 | Kajiwara et al. | 416/181 |
| 5,437,541 | A * | 8/1995 | Vainrub | 416/223 R |
| 5,785,497 | A | 7/1998 | White et al. | |
| 5,901,616 | A | 5/1999 | Miner et al. | |
| 6,015,264 | A | 1/2000 | Violette et al. | |
| 6,224,321 | B1 * | 5/2001 | Ebden et al. | 415/9 |
| 6,481,970 | B2 * | 11/2002 | Mukherjee et al. | 416/204 A |
| 6,951,448 | B2 | 10/2005 | Duesler et al. | |
| 7,374,402 | B2 * | 5/2008 | Thiele et al. | 416/204 R |
| 2007/0196206 | A1 * | 8/2007 | Martin et al. | 415/191 |
| 2007/0253804 | A1 * | 11/2007 | Heyerman | 415/9 |

* cited by examiner

*Primary Examiner* — Edward Look
*Assistant Examiner* — William Grigos
(74) *Attorney, Agent, or Firm* — Carlson, Gaskey & Olds, P.C.

(57) ABSTRACT

An impeller for use in a containment structure has a hub, a blade attaching to the hub for compressing air as the blade rotates with the hub, and an annulus disposed about the hub whereby the annulus reduces an effect of the hub breaking apart such that a weight of the containment structure is reduced.

13 Claims, 3 Drawing Sheets

ROTATING CATCHER FOR IMPELLER CONTAINMENT

BACKGROUND OF THE INVENTION

Auxiliary Power Engine manufacturers are required to demonstrate by test that the auxiliary rotor cases are able to contain damage caused by the failure of high energy rotor and blades. It is known that a "worst-case" rotor failure is defined if the rotor breaks into three equal weight pieces. This is referred to a tri-hub failure. The containment structure/case around a rotor, for instance, must be strong enough to absorb the energy of the three parts when it breaks apart during such a test.

To test containment structures, first a rotor, in this case an impeller is deliberately slotted in such a way to fail into three pieces when rotated to specified speed. This impeller is then placed into an engine and the engine is operated at it maximum attainable speed until the impeller fails, breaking into three pieces.

SUMMARY OF THE INVENTION

According to an exemplar herein, an impeller for use in a containment structure has a hub, a blade attaching to the hub for compressing air as the blade rotates with the hub, and an annulus disposed about the hub whereby the annulus reduces an effect of the hub breaking apart such that a weight of the containment structure is reduced.

According to a further exemplar herein a gas turbine engine compressor stage includes a containment structure with a case, a shroud, and a diffuser plate. A hub is in register with the shroud and the diffuser plate. A blade is attached to the hub for compressing air as the blade rotates with the hub. An annulus is disposed about the hub whereby the annulus is configured to absorb energy during break up of said hub into a plurality of parts.

According to a further exemplar herein an impeller includes a containment structure, a hub, and a blade in register with the containment vessel that attaches to the hub and compresses air as the blade rotates with the hub. The impeller also includes an annulus disposed about the hub whereby the annulus minimizes an effect of the hub breaking apart such that a weight of the containment vessel is minimized.

According to a still further exemplar herein, a method for minimizing weight of a containment structure includes providing a hub having a blade in register with the containment structure; providing an annulus about the hub whereby the annulus minimizes an effect of the hub breaking apart, and reducing a weight of said containment vessel.

These and other features of the present invention can be best understood from the following specification and drawings, the following of which is a brief description.

DETAILED DESCRIPTION OF THE PREFERRED EMBODIMENT

Figure 1:
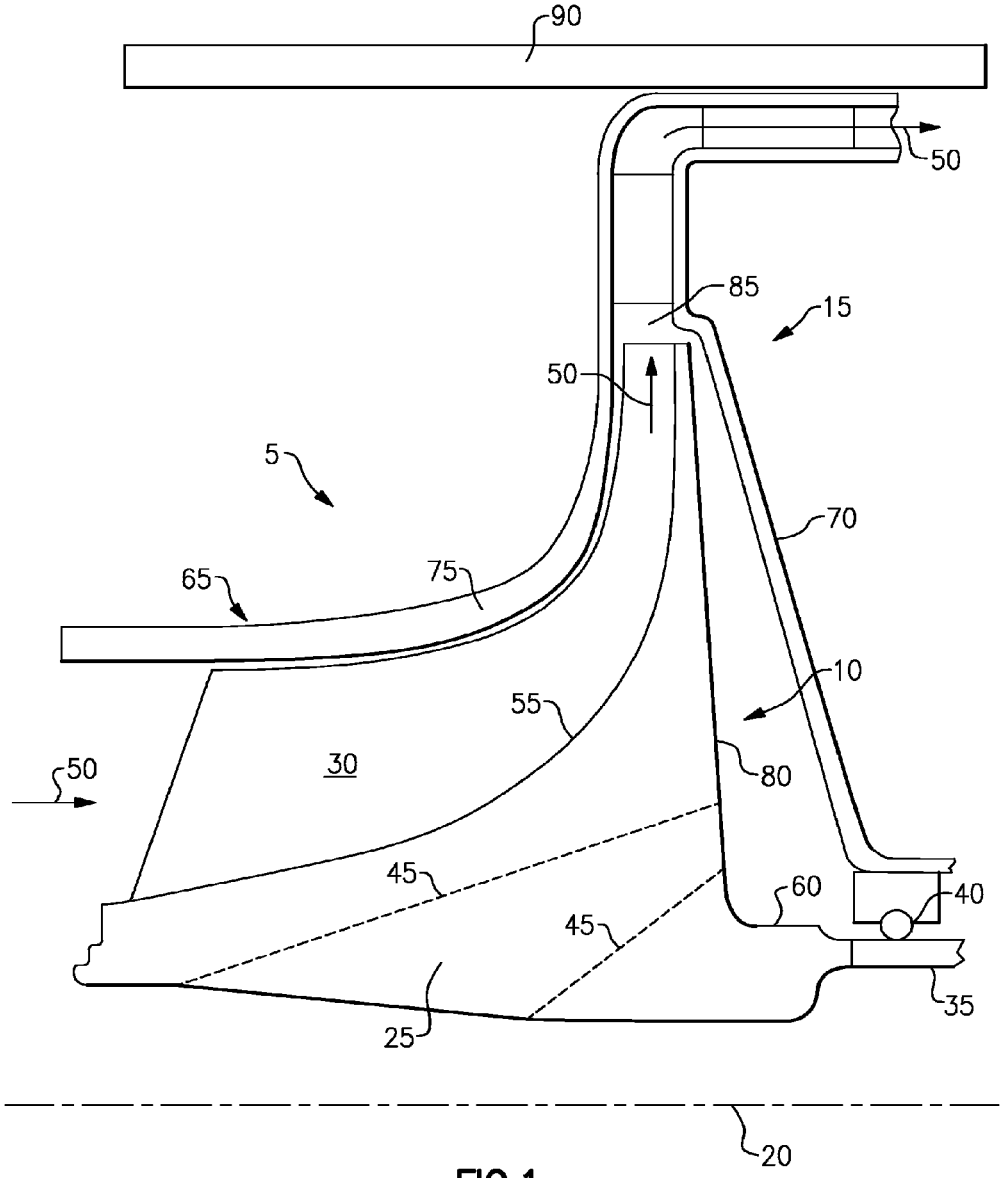
FIG. 1 Prior Art
FIG. 1 is a cross sectional view of a prior art impeller and its containment structure.

Referring to FIG. 1, a prior art gas turbine engine compressor stage 5 with an impeller 10 and its containment structure

15, prepared for testing, is shown. The impeller 10 has a hub 25 disposed about an axial center line 20 and a compressor blade 30. The hub 25 attaches to an axle 35 that is supported by bearings 40 and attaches to a turbine (not shown and is known in the art) to rotate the impeller 10 to its maximum attainable speed (typically 110% above its rated speed). Because the hub 25 has several grooves 45 scored or machined into it, the hub 25 is designed to break apart at 110% of rated speed to test the containment structure 15.

The hub 25 has roughly triangular cross-section having a curved hypotenuse 55. A roughly cylindrical neck 60 attaches the hub 25 conventionally to the axle 35 and axially removed from the blade 30. The hub 25 may be made of titanium or an Inconel® steel or the like.

The containment structure 15 includes a case 90 that acts as an outer band to contain fragments of the impeller 10. The containment structure 15 also includes a shroud 65 and a diffuser plate 70, which also function in conjunction with the impeller 10 to channel air 50 to a burner section (not shown) of a gas turbine engine (not shown). The shroud 65 has a curved portion 75 that closely contours a shape of the blade 30, and the diffuser plate 70 roughly contours to the right side 80 of the hub 25. The diffuser plate 70 in this example anchors the bearing 40 (in some auxiliary power units, bearing location may be different).

The diffuser plate 70 and the shroud 65 merge together to form a passageway 85 which directs air 50 driven by the impeller 10 to a burner section (not shown). The shroud 65, the diffuser plate 70, and the passageway 85 are enclosed by the case 90.

For testing purposes, the grooves 45 are machined into the hub 25 so that if the impeller 10 is driven at greater than 110 percent of its rated speed, the impeller 10 breaks into parts that are contained by the containment structure 15. To contain the failure, the shroud 65, the diffuser plate 70 and the case 90 must be designed to absorb the energy of the parts of the hub 25 that are hurled into them. However, to absorb this energy the case 90, the shroud 65 and the diffuser plate 70, as described herein must be strong and ductile with a sufficient thickness to prevent parts from escaping the case 90.

Figure 2:
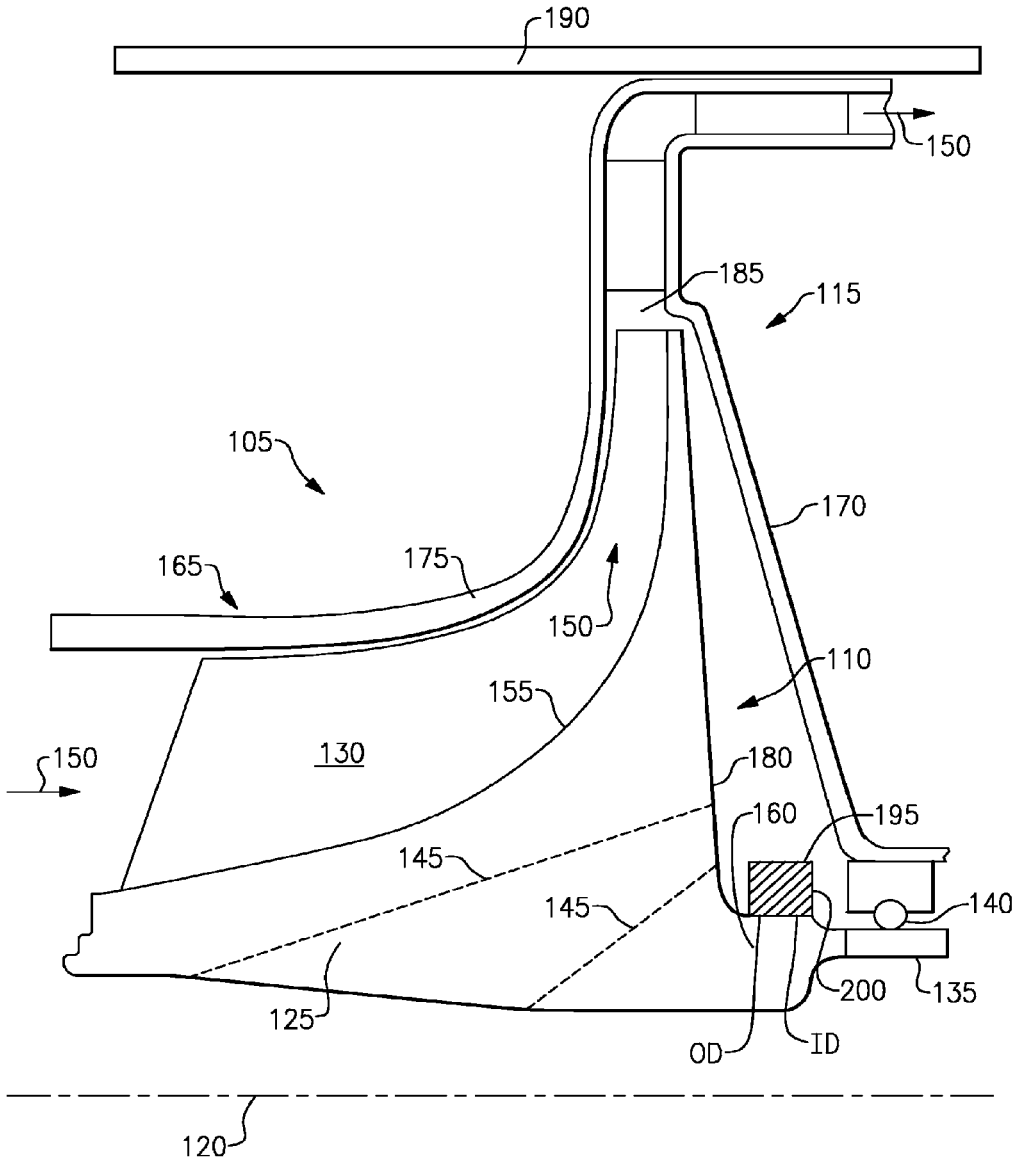
FIG. 2 shows a perspective view of an impeller and its containment structure.

Referring to FIG. 2, an embodiment of a gas turbine engine compressor stage 105 with an impeller 110 and a containment structure 115, for use with an APU or other gas turbine engine, is shown. The impeller 110 has a hub 125 disposed about an axial center line 120 and a compressor blade 130 attaching to the hub 125. The hub 125 attaches to an axle 135 that is supported by bearings 140 and attaches to a turbine (not shown and is known in the art) to rotate the impeller 110 and the blade 130 that act as a compressor driving compressed air 150 through passageway 185.

The hub 125 has roughly triangular cross-section having a curved hypotenuse 155. A roughly cylindrical neck 160 attaches the hub 125 conventionally to the axle 135. The hub 125 may be made of titanium or an Inconel® steel or the like.

The containment structure 115 includes a case 190 that acts as an outer band to contain fragments of the impeller 110. The containment structure 115 also includes a shroud 165 and a diffuser plate 170, which also function in conjunction with the impeller 110 to channel compressed air 150 to a burner section (not shown) of a gas turbine engine (not shown). The shroud 165 has a curved portion 175 that closely contours and is in register with a shape of the blade 130 and the diffuser plate 170 roughly contours and is in register with the right side 180 of the hub 125. The diffuser plate 170 anchors the bearing 140.

The diffuser plate 170 and the shroud 165 merge together to form passageway 185 which directs air 150 driven by the impeller 110 to a burner section (not shown). The shroud 165, the diffuser plate 170, and the passageway 185 are enclosed by the case 190.

The grooves 145 machined into the hub 125 so that if the impeller 110 is driven at greater than 110 percent of its rated speed, the impeller breaks into parts that are contained by the containment vessel 190.

Figure 3:
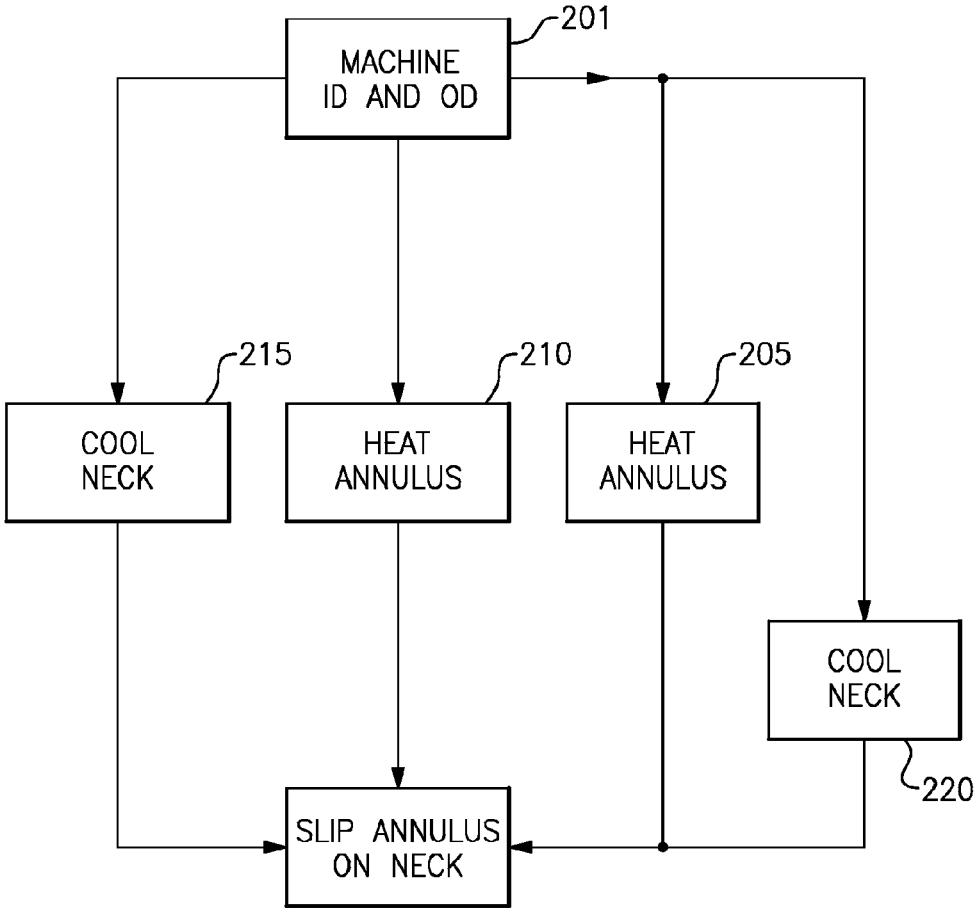
FIG. 3 shows a method for placing an annulus on a neck.

An annulus 195 having roughly a rectangular cross section 200 is press or interference fit onto the neck 160 of the impeller 125. Referring now to FIG. 3, after precision machining the diameters (e.g., the outer diameter ("OD") (step 201) of the impeller neck 160 and the internal diameter ("ID") of the annulus 195) that mate between the annulus 195 and the impeller neck 160, then the annulus 195 may be heated thereby expanding the ID (steps 205, 210) of the annulus, and the impeller neck 160 may be cooled (steps 215, 220) thereby shrinking the OD of the neck so the annulus 195 may be slid onto the impeller neck 160. The annulus may also be heated and the neck cooled simultaneously (steps 205 and 220). As the impeller neck 160 and the annulus 195 return to room temperature, an interference fit is formed therebetween.

The cross section 200 is rectangular though other shapes are contemplated herein. The annulus 195 is a ring made of a strong material such as Inconel® 625 steel or titanium. By applying the annulus 195 to the neck 160, as the impeller 110 begins to break apart during testing or during operation due to defect or other reason, enough energy is absorbed by the annulus 195 during the break up that the damage inflicted on the containment structure 115 by the three parts in a worst case impeller failure is less than that inflicted upon the containment structure 15 of FIG. 1 under similar operating and failure conditions. As such, the case 190, shroud 165 and diffuser plate 170 may be designed with a reduced thickness relative to the case 90, shroud 65, and diffuser plate 70 of FIG. 1. For instance, the case 190 and the shroud 165 is two-thirds of the thickness of the corresponding thickness of the case 90 and the shroud 65. The reduced thickness of case 190, shroud 165, and/or diffuser plate 170 collectively have less weight than the weight of the annulus 195, and therefore the overall weight of the engine is diminished without affecting the ability of the containment structure 115 to perform. As an example, the annulus 195 may weigh about one and one-half pounds (e.g., 0.7 kgs), and the weight shed by the case 190, shroud 165 and diffuser plate 170 may be three pounds (e.g., 1.4kg) or more.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An impeller for use in a containment structure, comprising:

a hub including a neck for receiving rotative force;

a blade attached to said hub and configured to compress air as said blade rotates with said hub; and an annulus disposed about said neck, whereby said annulus reduces an effect of said hub breaking apart into a plurality of parts such that a weight of said containment structure is reduced relative to a second containment structure containing said impeller absent said annulus, wherein both said containment structure and said second containment structure are of sufficient thicknesses to contain said plurality of parts and said annulus is axially removed from said blade.

2. The impeller of claim 1 wherein said annulus is interference fit about said neck.

3. The impeller of claim 1 wherein said annulus has a rectangular cross section.

4. A gas turbine engine compressor stage comprising:

a containment structure comprising:

a case providing an outer band;

a shroud; and a diffuser plate;

a hub including a neck for receiving rotative force and in register with said shroud and said diffuser plate;

a blade attached to said hub for compressing air as said blade rotates with said hub wherein said neck is axially removed from said blade; and an annulus disposed about said neck, whereby said annulus is configured to absorb energy during break up of said hub into a plurality of parts and said annulus is axially removed from said blade.

5. The gas turbine engine compressor stage of claim 4 wherein said annulus is interference fit about said neck.

6. The gas turbine engine compressor stage of claim 4 wherein said annulus has a rectangular cross section.

7. An compressor section of a turbine engine, comprising:

a containment structure;

a hub including a neck;

a blade attached to said hub that compresses air as said blade rotates with said hub, said blade in register with said containment vessel; and an annulus disposed about said hub whereby said annulus minimizes an effect of said hub breaking apart such that a weight of said containment vessel is minimized and said annulus is axially removed from said blade.

8. A method for minimizing weight of a containment structure, said method comprising:

providing a hub having a blade in register with said containment structure, wherein said hub includes a neck that is axially removed from said blade;

providing an annulus about said hub whereby said annulus minimizes an effect of said hub breaking apart, and said annulus is axially removed from said blade reducing a weight of said containment vessel.

9. The method of claim 8 wherein providing an annulus about said hub further comprises providing an interference fit between said neck and said annulus.

10. The method of claim 9 wherein said providing said interference fit between said neck and said annulus further comprises expanding an inner diameter of said annulus before placing said annulus on said neck.

11. The method of claim 9 wherein said providing said interference fit between said neck and said annulus further comprises shrinking an outer diameter of said neck before placing said annulus on said neck.

12. The method of claim 9 wherein said providing said interference fit between said neck and said annulus further comprises expanding an inner diameter of said annulus and shrinking said outer diameter of said neck before placing said annulus on said neck.

13. The impeller of claim 1 wherein said hub is comprised of a first material and said annulus is comprised of a second material different from the first material.

* * * * *